US010894305B2

(12) United States Patent
Sato et al.

(10) Patent No.: US 10,894,305 B2
(45) Date of Patent: Jan. 19, 2021

(54) DRESSER

(71) Applicant: SUMITOMO ELECTRIC HARDMETAL CORP., Itami (JP)

(72) Inventors: Takeshi Sato, Itami (JP); Tadashi Yamaguchi, Itami (JP); Shinichiro Yurugi, Itami (JP)

(73) Assignee: SUMITOMO ELECTRIC HARDMETAL CORP., Hyogo (JP)

( * ) Notice: Subject to any disclaimer, the term of this patent is extended or adjusted under 35 U.S.C. 154(b) by 0 days.

(21) Appl. No.: 16/624,982

(22) PCT Filed: Mar. 27, 2019

(86) PCT No.: PCT/JP2019/013137

§ 371 (c)(1),
(2) Date: Dec. 20, 2019

(87) PCT Pub. No.: WO2019/198503

PCT Pub. Date: Oct. 17, 2019

(65) Prior Publication Data

US 2020/0215664 A1 Jul. 9, 2020

(30) Foreign Application Priority Data

Apr. 12, 2018 (JP) ..... 2018-076822

(51) Int. Cl.
*B24B 53/12* (2006.01)
*B24B 53/017* (2012.01)
(Continued)

(52) U.S. Cl.
CPC ..... *B24B 53/14* (2013.01); *B24B 53/017* (2013.01); *B24B 53/047* (2013.01); *B24B 53/12* (2013.01); *B24D 5/06* (2013.01)

(58) Field of Classification Search
CPC ..... B24B 53/00; B24B 53/017; B24B 53/02; B24B 53/047; B24B 53/12; B24B 53/14; B24D 15/02; B24D 15/06
(Continued)

(56) References Cited

U.S. PATENT DOCUMENTS 7,690,442 B2 * 4/2010 Portwood ..... E21B 10/52 175/57
2006/0260846 A1 * 11/2006 Portwood ..... E21B 10/16 175/331
(Continued)

FOREIGN PATENT DOCUMENTS

JP S60-39454 U 3/1985
JP H08-229818 A 9/1996
(Continued)

*Primary Examiner* — Eileen P Morgan
(74) *Attorney, Agent, or Firm* — Faegre Drinker Biddle & Reath LLP

(57) ABSTRACT

A dresser includes: a mount component; and a cutting edge component inserted in the mount component at a base end portion side, wherein the portion of the cutting edge component inserted in the mount component has one or more portions in each of which an area of a cross section is increased from the front end portion side toward the base end portion side in the insertion direction, and a ratio L1/M1 of a length L1 and a maximum value M1 is more than or equal to 2.1, where L1 represents a length of the portion of the cutting edge component inserted in the mount component and M1 represents a maximum value of a diameter of a circle having an area equal to the area of the cross section of the portion of the cutting edge component inserted in the mount component.

9 Claims, 6 Drawing Sheets

(51) Int. Cl.
*B24B 53/047* (2006.01)
*B24D 5/06* (2006.01)
*B24B 53/14* (2006.01)

(58) Field of Classification Search
USPC ..... 451/56, 443, 552, 556
See application file for complete search history.

(56) References Cited

U.S. PATENT DOCUMENTS

2011/0240376 A1* 10/2011 Chen ..... E21B 10/55
175/336
2012/0152624 A1* 6/2012 Chen ..... G06F 30/17
175/428
2020/0215664 A1* 7/2020 Sato ..... B24B 53/14

FOREIGN PATENT DOCUMENTS

JP H10-15820 A 1/1998
JP 2002-264014 A 9/2002

* cited by examiner

DRESSER

TECHNICAL FIELD

The present disclosure relates to a dresser. The present application claims a priority based on Japanese Patent Application No. 2018-076822 filed on Apr. 12, 2018, the entire content of which is incorporated herein by reference.

BACKGROUND ART

Conventionally, diamond has been used as a material for dressers. For example, Japanese Patent Laying-Open No. 8-229818 (Patent Literature 1) discloses a diamond dresser, wherein a single-crystal columnar diamond is embedded in a dressing surface of a substrate.

In such a diamond dresser, a front end portion (portion exposed from the substrate) of the single-crystal columnar diamond serving as a cutting edge is gradually worn due to use thereof. The life thereof is expired in the following manner: a diamond portion ceases to exist; or the diamond portion falls off from the substrate before the diamond portion ceases to exist.

CITATION LIST

Patent Literature

PTL 1: Japanese Patent Laying-Open No. 8-229818

SUMMARY OF INVENTION

A dresser according to the present disclosure includes:

a mount component; and a cutting edge component inserted in the mount component at a base end portion side, the cutting edge component being fixed to the mount component by bringing, into contact with the mount component, a portion of the cutting edge component inserted in the mount component, the cutting edge component being exposed from the mount component at a front end portion side to form a cutting edge, wherein the portion of the cutting edge component inserted in the mount component has one or more portions in each of which an area of a cross section along a line normal to an insertion direction of the cutting edge component is increased from the front end portion side toward the base end portion side in the insertion direction, and a ratio L1/M1 of a length L1 and a maximum value M1 is more than or equal to 2.1, where L1 represents a length of the portion of the cutting edge component inserted in the mount component and M1 represents a maximum value of a diameter of a circle having an area equal to the area of the cross section along the line normal to the insertion direction in the portion of the cutting edge component inserted in the mount component.

DETAILED DESCRIPTION

Figure 1:
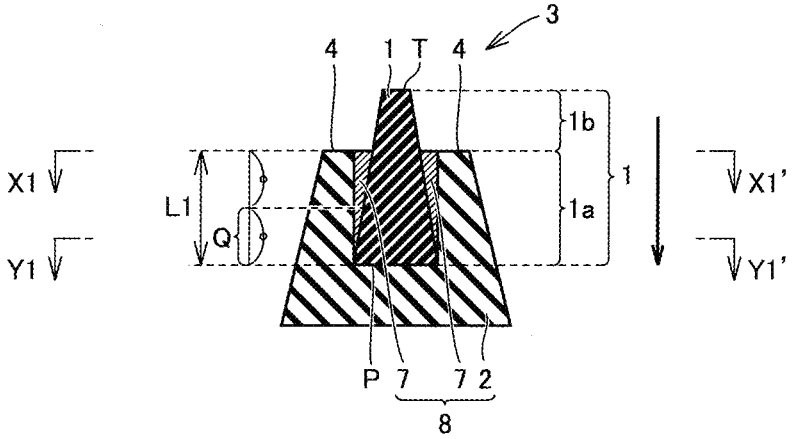
FIG. 1 is a schematic cross sectional view of a dresser according to a first embodiment.

Problem to be Solved by the Present Disclosure

Shape and area of the columnar diamond in Japanese Patent Laying-Open No. 8-229818 (Patent Literature 1) at a cross section perpendicular to the longitudinal direction are constant in the longitudinal direction except for manufacture tolerance. Accordingly, when the length of the columnar diamond, more specifically, the length of the embedded portion (portion embedded in the substrate) of the columnar diamond in the longitudinal direction becomes short as a result of repeated use of the front end portion of the dresser, a contact area between the embedded portion of the columnar diamond and the substrate becomes small to reduce force against a load applied from outside to the columnar diamond, with the result that the columnar diamond is facilitated to fall off from the substrate. As a result, the columnar diamond falls off from the substrate before completely using the columnar diamond in the longitudinal direction, with the result that an expected tool life may not be attained.

Thus, the present object is to provide a dresser having a long tool life.

Advantageous Effect of the Present Disclosure

The dresser according to the above-described embodiment can have a long tool life.

DESCRIPTION OF EMBODIMENTS

First, embodiments of the present disclosure are listed and described.

(1) A dresser according to the present disclosure includes:

a mount component; and a cutting edge component inserted in the mount component at a base end portion side, the cutting edge component being fixed to the mount component by bringing, into contact with the mount component, a portion of the cutting edge component inserted in the mount component, the cutting edge component being exposed from the mount component at a front end portion side to form a cutting edge, wherein the portion of the cutting edge component inserted in the mount component has one or more portions in each of which an area of a cross section along a line normal to an insertion direction of the cutting edge component is increased from the front end portion side toward the base end portion side in the insertion direction, and a ratio L1/M1 of a length L1 and a maximum value M1 (hereinafter, also referred to as "(L1/M1)") is more than or equal to 2.1, where L1 represents a length of the portion of the cutting edge component inserted in the mount component and M1 represents a maximum value of a diameter of a circle having an area equal to the area of the cross section along the line normal to the insertion direction in the portion of the cutting edge component inserted in the mount component.

This dresser can have a long tool life.

(2) Preferably, a distance in the insertion direction to the base end portion of the cutting edge component from at least one of the portions in each of which the area of the cross section of the portion of the cutting edge component inserted in the mount component along the line normal to the insertion direction is increased from the front end portion side toward the base end portion side is less than ½ of the length L1, where L1 represents the length of the portion of the cutting edge component inserted in the mount component in the insertion direction. Accordingly, even when the cutting edge component is worn to become short due to use of the dresser, the cutting edge component is less likely to be separated, whereby the dresser can have a longer tool life.

(3) Preferably, a difference M1-M2 between the maximum value M1 and a minimum value M2 (hereinafter, also referred to as "(M1-M2)") is more than or equal to 0.01 mm, where M1 represents the maximum value of the diameter of the circle having the area equal to the area of the cross section along the line normal to the insertion direction in the portion of the cutting edge component inserted in the mount component, and M2 represents a minimum value of the diameter of the circle having the area equal. Accordingly, even when the cutting edge component is worn to become short due to use of the dresser, the cutting edge component is less likely to be separated, whereby the dresser can have a longer tool life.

(4) Preferably, the cutting edge component includes diamond or cubic boron nitride. Since each of diamond and cBN has a high hardness, the dresser can have an excellent wear resistance when each of these is used for the cutting edge component, whereby a longer tool life can be attained.

(5) Preferably, the cutting edge component is composed of a single-crystal diamond, and a surface of the cutting edge component to come into contact with a workpiece corresponds to a (100) plane, a (110) plane or a (211) plane. Since the (100) plane, the (110) plane and the (211) plane of diamond provides excellent wear resistance, the dresser can have a excellent wear resistance when each of these is used for the surface to come into contact with a workpiece, whereby a longer tool life can be attained.

(6) Preferably, the area of the cross section of the portion of the cutting edge component inserted in the mount component along the line normal to the insertion direction has a maximum value at the base end portion of the portion of the cutting edge component inserted in the mount component. Accordingly, even when the cutting edge component is worn to become short due to use of the dresser, the cutting edge component is less likely to be separated, whereby the dresser can have a longer tool life.

(7) Preferably, the area of the cross section is monotonously increased as a distance is decreased between the cross section and the base end portion of the portion of the cutting edge component inserted in the mount component along the insertion direction. Accordingly, even when the cutting edge component is worn to become short due to use of the dresser, the cutting edge component is less likely to be separated and is less likely to be broken, whereby the dresser can have a longer tool life.

(8) Preferably, the area of the cross section of the portion of the cutting edge component inserted in the mount component along the line normal to the insertion direction is once decreased and then increased as a distance is decreased between the cross section and the base end portion of the portion of the cutting edge component inserted in the mount component along the insertion direction. Accordingly, even when the cutting edge component is worn to become short due to use of the dresser, the cutting edge component is less likely to be separated, whereby the dresser can have a longer tool life.

(9) Preferably, the dresser is a point type single-point dresser, a blade type multi-point dresser, or a rotary type dresser. Even when the cutting edge component is worn to become short due to use of each of these dressers, the cutting edge component is less likely to be separated, whereby the dresser can have a longer tool life.

DETAILS OF EMBODIMENTS OF THE PRESENT DISCLOSURE

The following describes a specific example of a dresser of the present disclosure with reference to figures.

The same reference characters indicate the same or equivalent portions in the figures. Dimensions, such as length, width, thickness, and depth, are appropriately changed for clarity and simplification of the figures and do not represent actual dimensions.

First Embodiment

Figure 2:
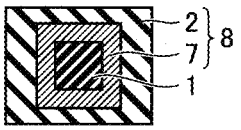
FIG. 2 is a cross sectional view along an X1-X1' line in the dresser shown in FIG. 1.
Figure 3:
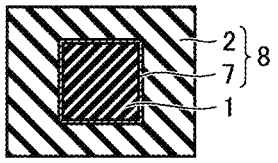
FIG. 3 is a cross sectional view along a Y1-Y1' line in the dresser shown in FIG. 1.
Figure 4:
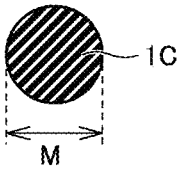
FIG. 4 shows a circle having an area equal to that of a cross section of a cutting edge component shown in FIG. 3.
Figure 14:
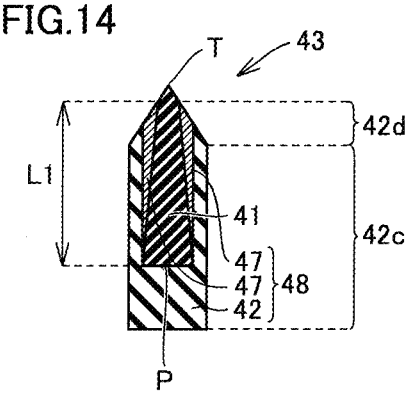
FIG. 14 is a schematic cross sectional view of a point type single-point dresser of the present disclosure.
Figure 15:
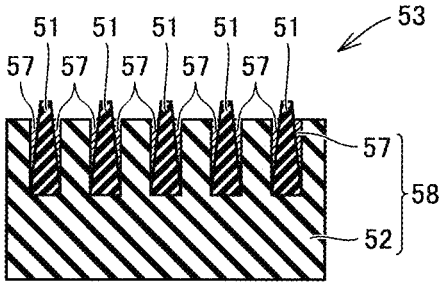
FIG. 15 is a schematic cross sectional view of a blade type multi-point dresser of the present disclosure.
Figure 16:
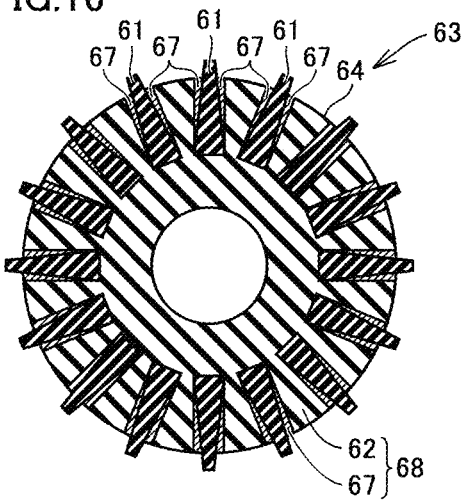
FIG. 16 is a schematic cross sectional view of a rotary type dresser of the present disclosure.

The following describes a dresser according to a first embodiment with reference to FIG. 1 to FIG. 4 and FIG. 14 to FIG. 16. FIG. 1 is a schematic cross sectional view of the dresser according to the first embodiment. FIG. 2 is a cross sectional view along an X1-X1' line in the dresser shown in FIG. 1. FIG. 3 is a cross sectional view along a Y1-Y1' line in the dresser shown in FIG. 1. FIG. 4 shows a circle having an area equal to that of a cross section of a cutting edge component 1 shown in FIG. 3. FIG. 14 is a schematic cross sectional view of a point type single-point dresser of the present disclosure. FIG. 15 is a schematic cross sectional view of a blade type multi-point dresser of the present disclosure. FIG. 16 is a schematic cross sectional view of a rotary type dresser of the present disclosure.

As shown in FIG. 1, dresser 3 includes: a mount component 8; and a cutting edge component 1 including a portion (hereinafter, also referred to as "inserted portion") 1*a* inserted in mount component 8 along one insertion direction.

Mount component 8 holds and fixes cutting edge component 1 by way of contact with cutting edge component 1. As shown in FIG. 1, mount component 8 includes: a mount component substrate 2; and a joining material 7 at a region between mount component substrate 2 and cutting edge component 1. Joining material 7 is formed in the following manner: cutting edge component 1 is disposed in a recess of mount component substrate 2, then joining material source powder, such as sintered alloy powder, is provided in a space between mount component substrate 2 and cutting edge component 1, and sintering is performed. Joining material 7 is in contact with at least a portion of each of mount component substrate 2 and cutting edge component 1, and connects mount component substrate 2 and cutting edge component 1 to each other. By fixing mount component 8 to a machine tool (not shown) or the like, dresser 3 is fixed to the machine tool or the like.

For a material of mount component substrate 2, a carbon steel, an alloy steel, various types of steel materials, or the like can be used. As a material of joining material 7, a sintered alloy can be used.

In dresser 3 shown in FIG. 1, mount component 8 has such a shape that one recess is formed in the upper surface of a quadrangular truncated pyramid. Cutting edge component 1 is inserted in and held in the recess. A region serving as a dressing surface is a region including: the surface of mount component 8 in which the recess is formed; and the cutting edge component on the same plane as the surface in which the recess is formed, or cutting edge component 1 exposed from the recess.

The shape of mount component 8 is not limited to the shape shown in FIG. 1, and can be changed appropriately depending on a purpose of use of the dresser. Other exemplary shapes of the mount component will be described with reference to FIG. 14 to FIG. 16. However, the shape of the mount component is not limited to these.

A point type single-point dresser 43 shown in FIG. 14 includes a mount component 48 and a cutting edge component 41. Mount component 48 includes a mount component substrate 42 and a joining material 47. Mount component 48 includes: a cylindrical portion 42*c* long in the axial direction; and a truncated cone portion 42*d* continuous to one end of the cylindrical portion. Mount component 48 has such a shape that one recess is formed in the upper surface of truncated cone portion 42*d*. In the case of the point type single-point dresser, cylindrical portion 42*c* may have a prism shape and truncated cone portion 42*d* may have a truncated pyramid shape.

A blade type multi-point dresser 53 shown in FIG. 15 includes a mount component 58 and cutting edge components 51. Mount component 58 includes a mount component substrate 52 and joining materials 57. Mount component 58 has such a shape that a plurality of recesses are formed in the upper surface of a prism. The number of recesses can be appropriately changed depending on a purpose of use of the dresser.

A rotary type dresser shown in FIG. 16 includes a mount component 68 and cutting edge components 61. Mount component 68 includes a mount component substrate 62 and joining materials 67. Mount component 68 has such a shape that a plurality of recesses are formed in an outer circumferential surface of a roll. The number of recesses can be appropriately changed depending on a purpose of use of the dresser.

Cutting edge component 1 includes: portion 1*a* inserted in mount component 8 along the one insertion direction (a direction of a downward arrow in FIG. 1); and an exposed portion 1*b* exposed from mount component 8. In the present specification, an end portion P of cutting edge component 1 at the inserted portion 1*a* side represents a base end portion (hereinafter, also referred to as "base end portion P") of the cutting edge component, and an end portion T of cutting edge component 1 at the exposed portion 1*b* side represents a front end portion (hereinafter, also referred to as "front end portion T") of the cutting edge component.

Here, the term "insertion direction" refers to a direction from a dressing surface 4 toward inside of mount component 8 along a line normal to dressing surface 4, wherein dressing surface 4 represents the surface of mount component 8 in which the recess is formed. As shown in FIG. 16, when a dressing surface 64 is a curved surface, the insertion direction refers to a direction from dressing surface 64 toward the inside of mount component 68 along a line normal to a tangent plane of dressing surface 64.

Portion 1*a* of cutting edge component 1 inserted in mount component 8 has one or more portions in each of which an area of a cross section along a line normal to the insertion direction of cutting edge component 1 is increased from the front end portion T side toward the base end portion P side in the insertion direction. A specific example of the shape of cutting edge component 1 will be described below.

In dresser 3 shown in FIG. 1, cutting edge component 1 has a quadrangular truncated pyramid shape. A cross sectional shape of cutting edge component 1 along a X1-X1' line (dressing surface 4) is a rectangular shape as shown in FIG. 2, and a cross sectional shape of cutting edge component 1 along a Y1-Y1' line is a rectangular shape having a larger area than that in FIG. 2 as shown in FIG. 3.

Therefore, in dresser 3 shown in FIG. 1, inserted portion 1*a* of cutting edge component 1 has one or more portions in each of which the area of the cross section along the line normal to the insertion direction is increased from the front end portion side toward the base end portion P side in the insertion direction. More specifically, in the dresser shown in FIG. 1, the area of the cross section of inserted portion 1*a* of cutting edge component 1 along the line normal to the insertion direction is monotonously increased from the front end portion T side toward the base end portion P side in the insertion direction. The whole of inserted portion 1*a* of cutting edge component 1 corresponds to the "portion of the inserted portion in which the area of the cross section along the line normal to the insertion direction is monotonously increased from the front end portion side toward the base end portion side in the insertion direction" (hereinafter, also referred to as "portion with an increased cross sectional area").

FIG. 1 shows a case where the whole of the inserted portion of the cutting edge portion correspond to the "portion with an increased cross sectional area"; however, a portion of the inserted portion of the cutting edge portion may be the "portion with an increased cross sectional area". For example, when the inserted portion of the cutting edge component has a portion in which the area of the cross section along the line normal to the insertion direction is monotonously increased from the front end portion T side toward the base end portion P side in the insertion direction, the portion of the cutting edge component corresponding to the portion in which the area is monotonously increased corresponds to the "portion of the inserted portion in which the area of the cross section along the line normal to the insertion direction is monotonously increased from the front end portion side toward the base end portion side in the insertion direction" (hereinafter, also referred to as "portion with an increased cross sectional area").

The shape of cutting edge component 1 is not limited to the quadrangular truncated pyramid, and can be a circular cone, a circular truncated cone, a pyramid, or a truncated pyramid other than the quadrangular truncated pyramid, for example. When the cutting edge component having such a shape is inserted in mount component 8 such that the bottom surface thereof serves as base end portion P and the apex side thereof serves as front end portion T, the area of the cross section of the inserted portion of the cutting edge component along the line normal to the insertion direction is monotonously increased from the front end portion T side toward the base end portion P side in the insertion direction.

When inserted portion 1*a* of cutting edge component 1 has one or more portions in each of which the area of the cross section along the line normal to the insertion direction is increased from the front end portion T side toward the base end portion P side in the insertion direction, a fitted portion is formed between inserted portion 1*a* and mount component 8, with the result that cutting edge component 1 is less likely to be separated from mount component 8. Therefore, even when the cutting edge component is worn to become short due to use of the dresser, the cutting edge component is not separated from the mount component, whereby the dresser can have a long tool life.

Conventionally, in order to prevent the cutting edge component from being separated from the mount component, the cutting edge component and the mount component are firmly joined to each other using a sintered alloy. Accordingly, the cutting edge component is subjected to a high-temperature and high-pressure condition during joining and a difference in thermal expansion between the cutting edge component and the sintered alloy becomes large, with the result that an excessive load may be applied to the cutting edge component to cause damage therein. If there is damage inside the cutting edge component, a damage portion is exposed when the cutting edge component is worn due to use of the dresser, thus resulting in a short tool life.

In the dresser of the present embodiment, the cutting edge component is less likely to be separated from the mount component, whereby the cutting edge component can be fixed to the mount component under such conditions that the load on the cutting edge component is smaller than that in the conventional art. Specifically, a sintering pressure can be reduced, a sintering temperature can be reduced, and a powder metal having a small thermal expansion coefficient can be used. Therefore, damage is less likely to be caused inside the cutting edge component during joining, whereby the dresser can have a long tool life.

A ratio (L1/M1) of a length L1 and a maximum value M1 is more than or equal to 2.1, where L1 (see FIG. 1) represents a length of the portion of the cutting edge component inserted in the mount component along the insertion direction and M1 represents a maximum value of a diameter M (see FIG. 4) of a circle having an area equal to the area of the cross section along the line normal to the insertion direction in the portion of the cutting edge component inserted in the mount component.

In the dresser of the present embodiment, when cutting edge component 1 is worn due to use of the dresser, cutting edge component 1 can be restored for use by polishing cutting edge component 1 and mount component 8 surrounding cutting edge component 1. When the ratio (L1/M1) of length L1 and maximum value M1 is more than or equal to 2.1, the number of times of restoring the dresser surface is increased, whereby the dresser can have a long tool life. The ratio (L1/M1) is more preferably more than or equal to 2.1 and is further preferably more than or equal to 2.3. Although the upper limit value of the ratio (L1/M1) is not set particularly, the upper limit is preferably less than or equal to 8, and is more preferably less than or equal to 7 in view of manufacturing.

For example, length L1 is preferably more than or equal to 0.5 mm and less than or equal to 7 mm, is more preferably more than or equal to 1 mm and less than or equal to 6 mm, and is further preferably more than or equal to 1.5 mm and less than or equal to 5 mm.

Maximum value M1 is preferably more than or equal to 0.05 mm and less than or equal to 3.5 mm, is more preferably more than or equal to 0.1 mm and less than or equal to 3.0 mm, and is further preferably more than or equal to 0.2 mm and less than or equal to 2.5 mm.

A difference (M1−M2) between maximum value M1 and a minimum value M2 is preferably more than or equal to 0.01 mm, where M1 represents the maximum value of diameter M of the circle having the area equal to the area of the cross section along the line normal to the insertion direction in the portion of cutting edge component 1 inserted in mount component 8, and M2 represents a minimum value of diameter M of the circle having the area equal thereto. Accordingly, even when the cutting edge component is worn to become short due to use of the dresser, the cutting edge component is less likely to be separated, whereby the dresser can have a longer tool life.

The difference (M1−M2) between M1 and M2 is more preferably more than or equal to 0.015 mm and less than or equal to 0.55 mm, and is further preferably more than or equal to 0.025 mm and less than or equal to 0.45 mm.

As shown in FIG. 1, when L1 represents the length of portion 1*a* of cutting edge component 1 inserted in mount component 8 in the insertion direction, a distance in the insertion direction to base end portion P of cutting edge component 1 from at least one of the portions in each of which the area of the cross section of the portion of cutting edge component 1 inserted in mount component 8 along the line normal to the insertion direction is increased from the front end portion T side toward the base end portion P side is preferably less than ½ of length L1. Accordingly, even when the wear of the cutting edge component is progressed, the cutting edge component is less likely to be separated from the mount component until the length of the inserted portion reaches ½ of L1 (region indicated by Q in FIG. 1), whereby the dresser can have a longer tool life.

As shown in FIG. 1, the area of the cross section of portion 1*a* of cutting edge component 1 inserted in mount component 8 along the line normal to the insertion direction preferably has a maximum value at base end portion P of inserted portion 1*a*. Accordingly, the cutting edge component is less likely to be separated from the mount component until the wear of the cutting edge component reaches base end portion P, whereby the dresser can have a longer tool life.

As shown in FIG. 1, the area of the cross section is preferably monotonously increased as a distance between the cross section and base end portion P of the inserted portion along the insertion direction is decreased. Accordingly, the cutting edge component is less likely to be separated from the mount component until the wear of the cutting edge component reaches base end portion P, whereby the dresser can have a long tool life. Further, since the mechanical strength of the cutting edge component is improved to result in an improved breakage resistance, the dresser can have a longer tool life.

The cutting edge component may include no exposed portion, and may be constituted only of inserted portion 1*a*. That is, the whole of cutting edge component 1 may be inserted in mount component 8.

Cutting edge component 1 preferably includes diamond or cubic boron nitride (hereinafter, also referred to as "cBN").

Since each of diamond and cBN has high hardness, the dresser can have an excellent wear resistance when each of these is used for the cutting edge component, whereby a longer tool life can be attained.

As the diamond, any of a single-crystal diamond, a polycrystal diamond, and a sintered diamond, which are generally available and widely applicable, can be used.

Examples of the single-crystal diamond includes natural diamond and synthetic single-crystal diamond. The synthetic single-crystal diamond is readily processed into a desired shape, and is suitable as a material of the cutting edge component of the present embodiment. A method for producing the synthetic single-crystal diamond is not limited particularly. For example, a synthetic single-crystal diamond produced using a high-pressure synthetic method or a vapor phase synthetic method can be used. When the cutting edge component is composed of the single-crystal diamond, the surface of the cutting edge component to come into contact with a workpiece preferably corresponds to a (100) plane, a (110) plane or a (211) plane.

The method for producing the polycrystal diamond is not limited particularly. For example, a polycrystal diamond can be used which is obtained by sintering, under very high temperature and pressure, a carbon material having a graphite type layer structure without adding a sintering aid or catalyst.

The method for producing the sintered diamond is not limited particularly. For example, a sintered diamond can be used which is obtained by sintering diamond particles using a metal binder such as cobalt.

As the cubic boron nitride, it is possible to use: a cBN sintered material obtained by sintering cBN particles using a metal binder such as Co (cobalt) or Al (aluminum); a cBN sintered material obtained by sintering cBN particles using a ceramic binder such as TiN (titanium nitride) or TiC (titanium carbide); a binderless cBN sintered material obtained by directly converting hexagonal boron nitride into cubic boron nitride without using a catalyst and sintering it; and the like.

Second Embodiment

Figure 5:
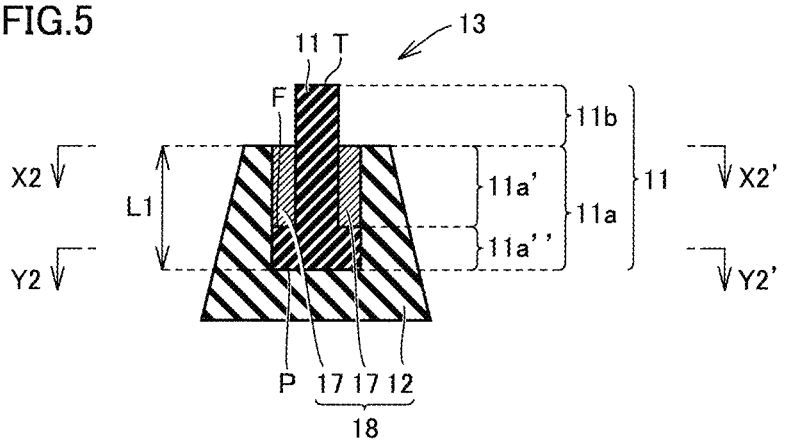
FIG. 5 is a schematic cross sectional view of a dresser according to a second embodiment.
Figure 6:
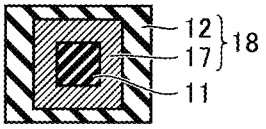
FIG. 6 is a cross sectional view along an X2-X2' line in the dresser shown in FIG. 5.
Figure 7:
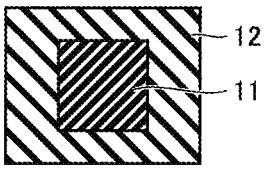
FIG. 7 is a cross sectional view along a Y2-Y2' line in the dresser shown in FIG. 5.

The following describes a dresser according to a second embodiment with reference to FIG. 5 to FIG. 7. FIG. 5 is a schematic cross sectional view of the dresser according to the second embodiment. FIG. 6 is a cross sectional view along an X2-X2' line in the dresser shown in FIG. 5. FIG. 7 is a cross sectional view along a Y2-Y2' line in the dresser shown in FIG. 5.

As shown in FIG. 5, dresser 13 includes: a mount component 18; and a cutting edge component 11 including a portion 11*a* inserted in mount component 18 along one insertion direction. The dresser of the second embodiment can have basically the same configuration as that of the dresser of the first embodiment except for the shape of cutting edge component 11 and a corresponding shape of a recess of mount component 18. Therefore, in the description below, the shape of cutting edge component 11 will be described.

Cutting edge component 11 includes an inserted portion 11*a* and an exposed portion 11*b*. Moreover, the cutting edge component may include no exposed portion and may be constituted only of inserted portion 11*a*.

In cutting edge component 11, inserted portion 11*a* includes: a first inserted portion 11*a*' having a cross section along a line normal to the insertion direction, the cross section of first inserted portion 11*a*' having the same shape as that of the cross section of the dressing surface; and a second inserted portion 11*a*" that has a cross sectional area larger than that of first inserted portion 11*a*' and that is located at the base end portion P side. That is, inserted portion 11*a* of cutting edge component 11 has one portion in which the area of the cross section along the line normal to the insertion direction is increased from the front end portion T side toward the base end portion P side in the insertion direction. When the cross sectional area is increased intermittently rather than continuously as in the present embodiment, the portion with an increased cross sectional area refers to a region on a boundary surface F between the portion (first inserted portion 11*a*') that has a first cross sectional area and the portion (second inserted portion 11*a*") that is located at the base end portion side relative to the portion having the first cross sectional area and that has a second cross sectional area larger than the first cross sectional area.

In the second embodiment, the side surface of inserted portion 11*a* has a protrusion at the base end portion P side in the insertion direction, thus providing a fitted portion between inserted portion 11*a* and mount component 18. Accordingly, cutting edge component 11 is less likely to be separated from mount component 18.

Furthermore, the cross sectional shape of first inserted portion 11*a*' is constant. Hence, even in the case where the cutting edge component is restored by polishing the cutting edge component when the cutting edge portion is worn, the same cutting edge shape as that before the restoring can be maintained. Therefore, the dresser having been restored can also maintain the same cutting performance as the cutting performance before the restoring.

Third Embodiment

Figure 8:
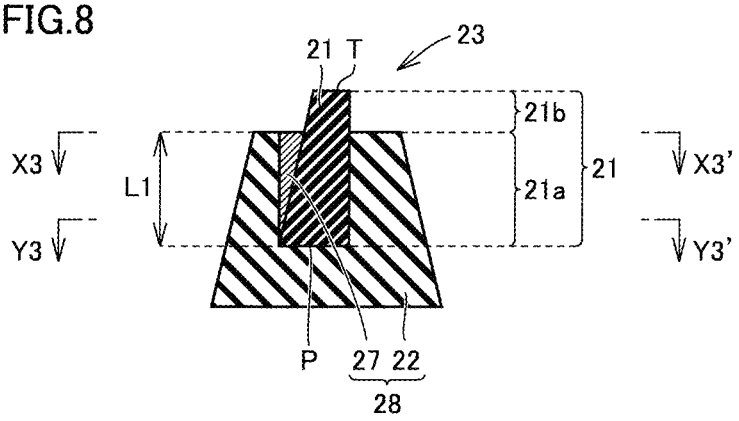
FIG. 8 is a schematic cross sectional view of a dresser according to a third embodiment.
Figure 9:
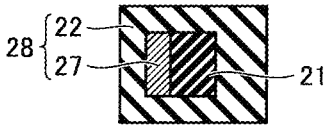
FIG. 9 is a cross sectional view along an X3-X3' line in the dresser shown in FIG. 8.
Figure 10:
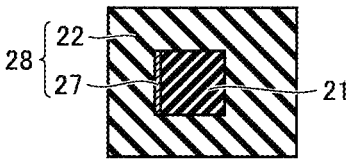
FIG. 10 is a cross sectional view along a Y3-Y3' line in the dresser shown in FIG. 8.
Figure 17:
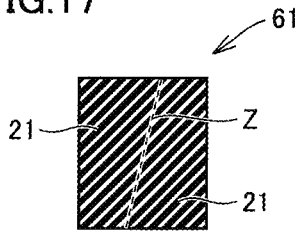
FIG. 17 illustrates an exemplary method for manufacturing a cutting edge component used for the dresser according to the third embodiment.

The following describes a dresser according to a third embodiment with reference to FIG. 8 to FIG. 10 and FIG. 17. FIG. 8 is a schematic cross sectional view of the dresser according to the third embodiment. FIG. 9 is a cross sectional view along an X3-X3' line in the dresser shown in FIG. 8. FIG. 10 is a cross sectional view along a Y3-Y3' line in the dresser shown in FIG. 8. FIG. 17 illustrates an exemplary method for manufacturing a cutting edge component used for the dresser of the third embodiment.

As shown in FIG. 8, dresser 23 includes: a mount component 28; and a cutting edge component 21 including a portion 21*a* inserted in mount component 28 along one insertion direction. The dresser of the third embodiment can have basically the same configuration as that of the dresser of the first embodiment except for the shape of cutting edge component 21 and a corresponding shape of a recess of mount component 28. Therefore, in the description below, the shape of cutting edge component 21 will be described.

Cutting edge component 21 includes an inserted portion 21*a* and an exposed portion 21*b*. Moreover, the cutting edge component may include no exposed portion and may be constituted only of inserted portion 21*a*.

Cutting edge component 21 can be obtained by equally dividing a cutting edge component precursor 61 into two at a position indicated by a dotted line Z, for example. Cutting edge component precursor 61 has a prism shape such as one shown in FIG. 17.

The area of inserted portion 21*a* of cutting edge component 21 at a cross section along a line normal to the insertion direction is monotonously increased as a distance is decreased between the cross section and base end portion P of inserted portion 21*a* along the insertion direction. Therefore, as with the first embodiment, even when the cutting edge component is worn to become short due to use of the dresser, the cutting edge component is not separated from the mount component, whereby the dresser can have a long tool life. Further, the cutting edge component and the mount component can be fixed under such conditions that a load on the cutting edge component is smaller than that in the conventional art, with the result that damage is less likely to be caused inside the cutting edge component during joining. Accordingly, the dresser can have a long tool life.

Cutting edge component 21 can be obtained by equally dividing one cutting edge component precursor having a prism shape into two. Therefore, manufacturing loss of the cutting edge component is less likely to occur and therefore the dresser of the third embodiment is advantageous in terms of manufacturing cost.

Fourth Embodiment

Figure 11:
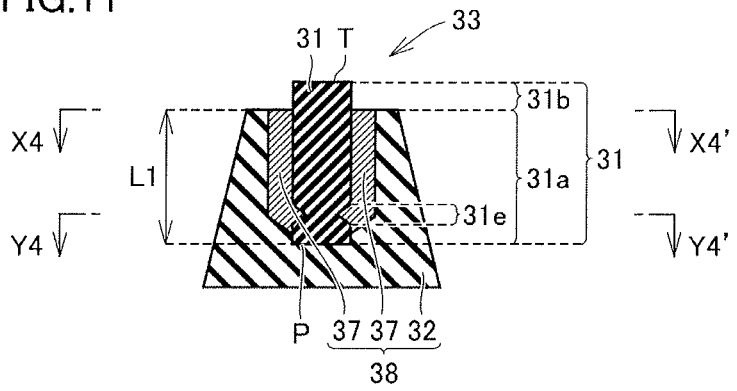
FIG. 11 is a schematic cross sectional view of a dresser according to a fourth embodiment.
Figure 12:
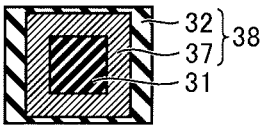
FIG. 12 is a cross sectional view along an X4-X4' line in the dresser shown in FIG. 11.
Figure 13:
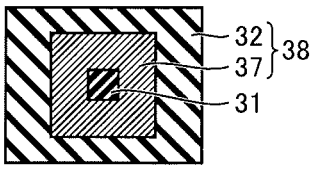
FIG. 13 is a cross sectional view along a Y4-Y4' line in the dresser shown in FIG. 11.

The following describes a dresser according to a fourth embodiment with reference to FIG. 11 to FIG. 13. FIG. 11 is a schematic cross sectional view of the dresser according to the fourth embodiment. FIG. 12 is a cross sectional view along an X4-X4' line in the dresser shown in FIG. 11. FIG. 13 is a cross sectional view along a Y4-Y4' line in the dresser shown in FIG. 11.

As shown in FIG. 11, dresser 33 includes: a mount component 38; and a cutting edge component 31 including a portion 31*a* inserted in mount component 38 along one insertion direction. The dresser of the fourth embodiment can have basically the same configuration as that of the dresser of the first embodiment except for the shape of cutting edge component 31 and a corresponding shape of a recess of mount component 38. Therefore, in the description below, the shape of cutting edge component 31 will be described.

Cutting edge component 31 includes an inserted portion 31*a* and an exposed portion 31*b*. Moreover, the cutting edge component may include no exposed portion and may be constituted only of inserted portion 31*a*.

The area of the cross section of the portion of cutting edge component 31 inserted in mount component 38 along the line normal to the insertion direction is once decreased and then increased as a distance is decreased between the cross section and base end portion P of inserted portion 31*a* along the insertion direction. Specifically, inserted portion 31*a* has such a shape that a hatch 31*e* is formed at a portion of a quadrangular prism. The side surface of inserted portion 31*a* is provided with a recess resulting from hatch 31*e*, thereby providing a fitted portion between inserted portion 31*a* and mount component 38. Accordingly, cutting edge component 31 is less likely to be separated from mount component 38.

Furthermore, the cross sectional shape of inserted portion 31*a* is constant except for hatch 31*e*. Hence, even in the case where the cutting edge component is restored by polishing the cutting edge component when the cutting edge portion is worn, the same cutting edge shape as that before the restoring can be maintained. Therefore, the dresser having been restored can also maintain the same cutting performance as the cutting performance before the restoring.

Fifth Embodiment

The shape of the cutting edge component of the dresser according to each of the first to fourth embodiments is applicable to any of a point type single-point dresser, a blade type multi-point dresser, and a rotary type dresser. Even when the cutting edge component is worn to become short due to use of each of the dressers, the cutting edge component is not separated from the mount component, whereby the dresser can have a long tool life. Further, since it is not necessary to join the cutting edge component and the mount component firmly, damage is less likely to be caused inside the cutting edge component during the joining, whereby the dresser can have a long tool life.

Sixth Embodiment

The following describes an exemplary method for manufacturing a dresser according to each of the first to fifth embodiments.

A mount component provided with a recess at a dressing surface is prepared. A cutting edge component is inserted into the recess of the mount component, and joining material source powder, such as sintered alloy source material powder, is provided in a space between the mount component and the cutting edge component. The cutting edge component has such a shape that is illustrated in each of the first to fourth embodiments, for example.

The mount component having the cutting edge component and the joining material source powder disposed in the recess is heated at a temperature of more than or equal to 500° C. and less than or equal to 700° C. under a sintering pressure of 0.5 t/cm$^2$ for more than or equal to 5 minutes and less than or equal to 10 minutes so as to sinter the joining material source powder, thereby joining the cutting edge component and the mount component to each other. In this way, a dresser is obtained.

In the conventional art, in order to avoid the cutting edge component from being separated from the mount component, the sintering is performed at a temperature of more than or equal to 800° C. and less than or equal to 900° C. under a sintering pressure of 1.0 to 1.5 t/cm$^2$ for more than or equal to 10 minutes and less than or equal to 15 minutes. In such a sintering condition, a high-temperature and high-pressure load is applied to the cutting edge component and a thermal expansion difference becomes excessive between the cutting edge component and the joining material source powder during the sintering, with the result that damage may be caused inside the cutting edge component. According to the present embodiment, the sintering can be performed at a lower temperature under a lower pressure for a shorter period of time than those in the conventional art, whereby damage can be suppressed from being caused inside the cutting edge component.

EXAMPLES

The following describes the present embodiment more specifically by way of examples. However, the present embodiment is not limited by these examples.

Example 1

In an Example 1, a point type single-point dresser having a shape shown in FIG. 14 is produced. Cutting edge component 41 is composed of a synthetic single-crystal diamond. A surface of cutting edge component 41 to come into contact with a workpiece corresponds to a (211) plane. Mount component 48 is composed of a carbon steel. For a joining material between the cutting edge component and the mount component, Fe—Cu—Sn is used.

The inserted portion of cutting edge component 41 has a quadrangular truncated pyramid shape. A cross section thereof along a line normal to an insertion direction is 0.6 mm square at a front end portion T, and is 1.12×0.6 mm square at a base end portion P. A length L1 of the inserted portion of cutting edge component 41 along the insertion direction is 3 mm. A maximum value M1 of a diameter of a circle having an area equal to that of the cross section of the inserted portion along the line normal to the insertion direction is 0.927 mm. A ratio (L1/M1) of length L1 and maximum value M1 is 3.24.

Comparative Example 1

In a Comparative Example 1, a point type single-point dresser having the same configuration as that of Example 1 except for the shape of the cutting edge component is produced.

The inserted portion of the cutting edge component has a quadrangular prism shape. The cross sectional shape thereof along the line normal to the insertion direction is unchanged along the insertion direction. The inserted portion of the cutting edge component is of 0.6 mm square. Length L1 of the inserted portion of the cutting edge component is 3 mm. Maximum value M1 of the diameter of the circle having an area equal to that of the cross section of the inserted portion along the line normal to the insertion direction is 0.677 mm. The ratio (L1/M1) of length L1 and maximum value M1 is 4.43.

<Evaluation of Dresser>

For evaluation of tool lives, wet type dressing was performed using each of the dressers of Example 1 and Comparative Example 1 under the following conditions: a WA grinding stone was used as a target; a grinding stone peripheral speed was set to 30 m/sec; and a cut-in amount was set to 0.05 mm.

In the dresser of Example 1, even when a wear amount of the cutting edge component was 2 mm, the dressing could be performed normally without the cutting edge component being separated from the mount component.

In the dresser of Comparative Example 1, when a wear amount of the cutting edge component was 2 mm, the cutting edge component was separated from the mount component, with the result that the dressing could not be performed.

It was confirmed that the tool life of the dresser of Example 1 is longer than that of the dresser of Comparative Example 1.

Example 2

In an Example 2, a point type single-point dresser having a shape shown in FIG. 14 is produced. Cutting edge component 41 is composed of a synthetic single-crystal diamond. A surface of cutting edge component 41 to come into contact with a workpiece corresponds to a (211) plane. Mount component 48 is composed of a carbon steel. For a joining material between the cutting edge component and the mount component, Fe—Cu—Sn is used.

The inserted portion of cutting edge component 41 has a quadrangular truncated pyramid shape. A cross section thereof along a line normal to an insertion direction is 1.1 mm square at a front end portion T, and is 1.31×1.1 mm square at a base end portion P. A length L1 of the inserted portion of cutting edge component 41 along the insertion direction is 3 mm. A maximum value M1 of a diameter of a circle having an area equal to that of the cross section of the inserted portion along the line normal to the insertion direction is 0.74 mm. A ratio (L1/M1) of length L1 and maximum value M1 is 2.21.

Comparative Example 2

In a Comparative Example 2, a point type single-point dresser having the same configuration as that of Example 2 except for the shape of the cutting edge component is produced.

The inserted portion of the cutting edge component has a quadrangular prism shape. The cross sectional shape thereof along the line normal to the insertion direction is unchanged along the insertion direction. The inserted portion of the cutting edge component is of 1.1 mm square. Length L1 of the inserted portion of the cutting edge component is 3 mm. Maximum value M1 of the diameter of the circle having an area equal to that of the cross section of the inserted portion along the line normal to the insertion direction is 1.24 mm. The ratio (L1/M1) of length L1 and maximum value M1 is 2.42.

Comparative Example 3

In a Comparative Example 3, a point type single-point dresser having the same configuration as that of Example 2 except for the shape of the cutting edge component is produced.

The inserted portion of the cutting edge component has a quadrangular truncated pyramid shape. The cross section thereof along the line normal to the insertion direction is 1.1 mm square at the front end portion, and is 1.625×1.1 mm square at the base end portion. Length L1 of the inserted portion of the cutting edge component is 3 mm. Maximum value M1 of the diameter of the circle having an area equal to that of the cross section of the inserted portion along the line normal to the insertion direction is 1.509 mm. The ratio (L1/M1) of length L1 and maximum value M1 is 1.99.

<Evaluation of Dresser>

For evaluation of tool lives, wet type dressing was performed using each of the dressers of Example 2, Comparative Example 2 and Comparative Example 3 under the following conditions: a WA grinding stone was used as a target; a grinding stone peripheral speed was set to 30 m/sec; and a cut-in amount was set to 0.05 mm.

In the dresser of Example 2, even when a wear amount of the cutting edge component was 2.2 mm, the dressing could be performed normally without the cutting edge component being separated from the mount component.

In the dresser of Comparative Example 2, when a wear amount of the cutting edge component was 2.2 mm, the cutting edge component was separated from the mount component, with the result that the dressing could not be performed.

In the dresser of Comparative Example 3, when a wear amount of the cutting edge component was 2.2 mm, the surface of the WA grinding stone serving as the target was melted to adhere thereto, with the result that the cutting edge portion fell off due to breakage. Accordingly, the dressing could not be continued.

It was confirmed that the tool life of the dresser of Example 2 is longer than that of the dresser of each of Comparative Examples 2 and 3.

Heretofore, the embodiments and examples of the present invention have been illustrated, but it has been initially expected to appropriately combine the configurations of the embodiments and examples and modify them in various manners.

The embodiments and examples disclosed herein are illustrative and non-restrictive in any respect. The scope of the present invention is defined by the terms of the claims, rather than the embodiments and examples described above, and is intended to include any modifications within the scope and meaning equivalent to the terms of the claims.

REFERENCE SIGNS LIST

1, 11, 21, 31, 41, 51, 61: cutting edge component; 2, 12, 22, 32, 42, 52, 62: mount component substrate; 3, 13, 23, 33: dresser; 7, 17, 27, 37, 47, 57, 67: joining material; 8, 18, 28, 38, 48, 58, 68: mount component; 43: point type single-point dresser; 53: blade type multi-point dresser; 63: rotary type dresser; P: base end portion; T: front end portion.

The invention claimed is:

1. A dresser comprising:

a mount component; and a cutting edge component inserted in the mount component at a base end portion side, the cutting edge component being fixed to the mount component by bringing, into contact with the mount component, a portion of the cutting edge component inserted in the mount component, the cutting edge component being exposed from the mount component at a front end portion side to form a cutting edge, wherein the portion of the cutting edge component inserted in the mount component has one or more portions in each of which an area of a cross section along a line normal to an insertion direction of the cutting edge component is increased from the front end portion side toward the base end portion side in the insertion direction, and a ratio L1/M1 of a length L1 and a maximum value M1 is more than or equal to 2.1, where L1 represents a length of the portion of the cutting edge component inserted in the mount component and M1 represents a maximum value of a diameter of a circle having an area equal to the area of the cross section along the line normal to the insertion direction in the portion of the cutting edge component inserted in the mount component.

2. The dresser according to claim 1, wherein a distance in the insertion direction to the base end portion of the cutting edge component from at least one of the portions in each of which the area of the cross section of the portion of the cutting edge component inserted in the mount component along the line normal to the insertion direction is increased from the front end portion side toward the base end portion side is less than ½ of the length L1, where L1 represents the length of the portion of the cutting edge component inserted in the mount component in the insertion direction.

3. The dresser according to claim 1, wherein a difference M1-M2 between the maximum value M1 and a minimum value M2 is more than or equal to 0.01 mm, where M1 represents the maximum value of the diameter of the circle having the area equal to the area of the cross section along the line normal to the insertion direction in the portion of the cutting edge component inserted in the mount component, and M2 represents a minimum value of the diameter of the circle having the area equal.

4. The dresser according to claim 1, wherein the cutting edge component includes diamond or cubic boron nitride.

5. The dresser according to claim 1, wherein the cutting edge component is composed of a single-crystal diamond, and a surface of the cutting edge component to come into contact with a workpiece corresponds to a (100) plane, a (110) plane or a (211) plane.

6. The dresser according to claim 1, wherein the area of the cross section of the portion of the cutting edge component inserted in the mount component along the line normal to the insertion direction has a maximum value at the base end portion of the portion of the cutting edge component inserted in the mount component.

7. The dresser according to claim 6, wherein the area of the cross section is monotonously increased as a distance is decreased between the cross section and the base end portion of the portion of the cutting edge component inserted in the mount component along the insertion direction.

8. The dresser according to claim 1, wherein the area of the cross section of the portion of the cutting edge component inserted in the mount component along the line normal to the insertion direction is once decreased and then increased as a distance is decreased between the cross section and the base end portion of the portion of the cutting edge component inserted in the mount component along the insertion direction.

9. The dresser according to claim 1, wherein the dresser is a point type single-point dresser, a blade type multi-point dresser, or a rotary type dresser.

* * * * *